US008302899B2

(12) United States Patent
Kipping et al.

(10) Patent No.: US 8,302,899 B2
(45) Date of Patent: Nov. 6, 2012

(54) WINDER FOR WINDING STRIPS

(75) Inventors: Matthias Kipping, Herdorf (DE); Helmut Höfer, Hilchenbach (DE); Reinhard Irle, Hilchenbach (DE); Thomas Holzhauer, Kirchhundem (DE)

(73) Assignee: SMS Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 12/448,797

(22) PCT Filed: Nov. 26, 2007

(86) PCT No.: PCT/EP2007/010240

§ 371 (c)(1),
(2), (4) Date: Jul. 27, 2009

(87) PCT Pub. No.: WO2008/083792

PCT Pub. Date: Jul. 17, 2008

(65) Prior Publication Data

US 2010/0059621 A1 Mar. 11, 2010

(30) Foreign Application Priority Data

Jan. 10, 2007 (DE) ..... 10 2007 002 218

(51) Int. Cl.
*B65H 18/14* (2006.01)

(52) U.S. Cl. ..... 242/541.4; 242/541.5; 242/541.6; 242/541.7; 242/547

(58) Field of Classification Search ..... 242/535.1, 242/541.1, 541.4–541.7, 547
See application file for complete search history.

(56) References Cited

U.S. PATENT DOCUMENTS

| | | | | |
|---|---|---|---|---|
| 3,602,448 | A | 8/1971 | Muensterer | |
| 4,380,164 | A * | 4/1983 | Kuwano | 72/10.1 |
| 4,530,224 | A * | 7/1985 | Hild et al. | 72/14.5 |
| 4,736,605 | A * | 4/1988 | Klockner et al. | 72/8.8 |
| 4,964,587 | A | 10/1990 | Oki et al. | |
| 5,275,345 | A * | 1/1994 | Stahl et al. | 242/547 |
| 6,036,137 | A | 3/2000 | Myren | |
| 6,648,264 | B1 * | 11/2003 | Kukizaki et al. | 242/422.5 |

FOREIGN PATENT DOCUMENTS

| | | |
|---|---|---|
| CA | 2220247 | 11/1996 |
| DE | 202006016209 | 12/2006 |
| EP | 0 963 932 | 12/1999 |
| GB | 2 092 111 | 8/1982 |
| JP | 54017837 | 2/1979 |
| JP | 55007169 | 1/1980 |
| JP | 57009531 | 1/1982 |
| JP | 59034804 | 3/1984 |
| JP | 60097156 | 5/1985 |
| JP | 62009717 | 1/1987 |
| JP | 8215750 | 8/1996 |

* cited by examiner

*Primary Examiner* — Sang Kim
(74) *Attorney, Agent, or Firm* — Lucas & Mercanti, LLP; Klaus P. Stoffel

(57) ABSTRACT

The invention relates to a winder (1) for winding strips (2), in particular thin metal strips, comprising a coiler drum (3) which is arranged such that it can rotate about a rotational axis (4), and at least one pivoting arm (5) which is arranged such that it can pivot about an axis (6) and which has at least one deflection plate (7) and at least one pressure roller (8), which deflect and press the strip (2) which is to be wound. In order to improve, in particular, the winding of thin strips, the invention provides for the at least one pressure roller (8) to be assigned at least one movement means (9), by way of which the pressure roller (8) can be moved relative to the pivoting arm (5).

7 Claims, 1 Drawing Sheet

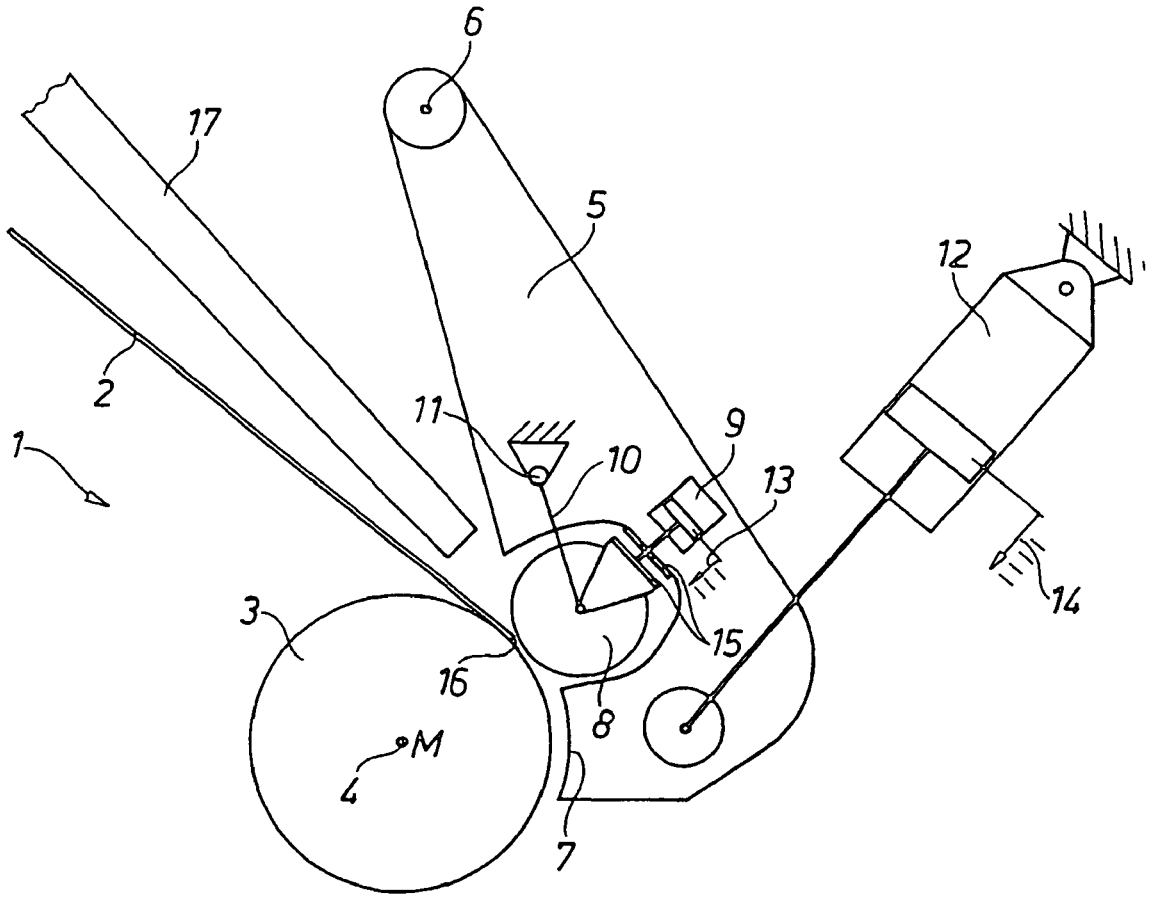
6
17
5
12
2
11
9
10
13
1
14
3
15
16
8
M
4
7

WINDER FOR WINDING STRIPS

The invention relates to a winding device for winding strip, particularly thin metal strip, comprising a coiler drum which is arranged so as be rotatable about an axis of rotation, and at least one pivoting arm which is arranged so as to be pivotable about an axis and which has at least one deflection plate and at least one pressure roller for deflecting or pressing on the strip to be wound.

Winding devices of this type are well known in the art. For winding metal strip, reeling devices are used which catch the metal strip, after it has left the finishing devices and has been transported over the runout roller conveyor, in the driving unit in order to deflect it at this location into the coiling shaft and to the coiling drum. In order to make it possible to wind the metal strip into a coil, pivoting arms are arranged around the coiler drum for tightly guiding the metal strip around the coiler drum. The pivoting arms are constructed essentially with a pressure roller and a deflection plate. In modern coilers the pivoting arms move by means of hydraulic cylinders. The conventionally used coilers usually have three or four pivoting arms.

In coilers of the first generation, the pivoting arms were moved by means of pneumatic cylinders; in addition, the pressure rollers were provided with springs, so that the pressure rollers were able to yield in case of jump in thickness of the strip, i.e., a step created by the strip beginning of a subsequent strip layer to be coiled.

In contrast, the hydraulic coiler of the type of the construction conventionally used today uses a strip beginning monitor and a hydraulic control for yielding to the step in the strip. This is carried out in such a way that the position of the strip beginning is computed and the hydraulic cylinder lifts the pivoting arm including the rigid pressure roller from the metal strip and permits the step of the strip to pass through. Once the step of the strip has passed through the roller, the pressure roller once again makes contact with the uppermost winding. This is carried out with all existing pivoting arms; this technology described above is also known under the name of "step control"

The hydraulic controls used for this purpose are highly dynamic and generally capable of carrying out their tasks. However, it is still difficult to accelerate and decelerate the large and heavy pivoting arms sufficiently quickly; this is due to the relatively high moment of inertia of the pivoting arms.

Of course, a fine control of the pivoting arms, as it is necessary especially for thin metal strips, can only be carried out with appropriate movement values and tolerances. A precisely sensitive manner of operation would have the advantage that a thin metal strip would not be damaged or only slightly damaged.

Therefore, it is the object of the invention to further develop a winding device of the above-described type in such a way that it becomes possible to wind in a precise manner even very thin strips, wherein the strips are to be wound in a gentle manner.

In accordance with the invention, this object is met by providing the winding device with at least one moving means for moving the at least one pressure roller relative to the pivoting arm.

Accordingly, contrary to the state of the art, for defining the position of the at least one pressure roller, the position of the pivoting arm alone is no longer the sole deciding factor, but that the pressure roller itself can be moved once again relative to the pivoting arm. This makes it necessary to move only small masses which makes it possible that a dynamic positioning of the pressure roller can be carried out.

In this connection, the moving means is capable of moving the pressure roller preferably at least substantially in the direction of the center point of the coiler drum. Consequently, the pressure roller is moved in such a way that it presses as much as possible perpendicularly against the strip.

The pressure roller may be mounted on a roller pivoting arm which is supported in the pivoting arm, wherein the axis of the pivoting arm and the axis of the roller pivoting arm are arranged parallel relative to each other. Consequently, a roller pivoting arm is mounted in the pivoting arm. Alternatively, it is also possible to arrange the pressure roller on a linear actuator which is fastened to the pivoting arm. In the latter case, the pressure roller is moved transitory relative to the pivoting arm. Also, a combination of both solutions is conceivable (pivoting movement and transitory movement).

The moving means for the movement of the pressure roller can be mounted in the pivoting arm itself. It can be constructed as a hydraulic or pneumatic piston/cylinder system. However, other solutions are also conceivable, for example, solutions providing mechanical moving means.

In most cases, several pivoting arms, preferably 3 or 4 pivoting arms, are provided for a coiler drum. The at least one pivoting arm can be pivoted by means of a moving element, wherein also in this case preferably hydraulic or pneumatic systems are used.

The pressure roller and the pivoting arm or the drives thereof preferably are provided with a distance measuring system which facilitates the manner of operation described further below.

It has also been found useful to provide a stop for the pressure roller arranged on the pivoting arm. In particular, strips to be wound having wider thicknesses which cause ramp-like steps of the strip, the pressure rollers can be pulled by means of their moving elements against their rigid stop.

An embodiment of the invention is illustrated in the drawing. The single FIGURE schematically shows a winding device for winding a thin metal strip in a side view.

The FIGURE shows a winding device 1 intended to wind a metal strip 2. For this purpose, a coiler drum 3 is provided which is rotatable about a horizontal axis of rotation 4. The strip 2 is delivered from a finishing plant, not shown, and is guided by a shaft flap 17 into a lower area where the coiler drum 3 is arranged.

To be able to wind the strip in an optimum manner on the coiler drum 3, a deflection plate 7 and a pressure roller 8 (or several parallel deflection plates 7 and pressure rollers 8) are provided which ensure that the strip 2 is placed in the best possible manner against the circumference of the coiler drum or against the strip material which has already been wound. The deflection plate 7 as well as the pressure roller 8 are supported by a pivoting arm 5 which is mounted so as to be pivotable about an axis of rotation 6 which is arranged parallel to the axis of rotation 4 of the coiler drum 3.

The pivoting arm 5 is moved by means of a moving element 12, i.e., a hydraulic piston/cylinder system. However, the moving element 12 has to move the entire pivoting arm 5 including all structural components mounted on it. Consequently, the pivoting arm 5 has a relatively high moment of inertia, particularly a high moment of inertia about the axis 6. This makes it very difficult to facilitate a highly dynamic movement, particularly of the pressure roller 8 which would be advantageous for a gentle manipulation particularly of thin strips 2.

Consequently, moving means 9 are provided which exclusively move the pressure roller 8 relative to the pivoting arm 5. These moving means are schematically illustrated as a hydraulic or pneumatic piston/cylinder system.

Moreover, in the illustrated example, the pressure roller 8 is arranged on a roller pivoting arm 10 which is also only schematically illustrated, wherein the roller pivoting arm 10 is mounted in a joint of the pivoting arm 5 in an axis 11 which extends parallel to the axis 6.

The arrangement of the roller pivoting arm 10 in the pivoting arm 5 is configured in such a way that, in the case of pivoting movements of the roller pivoting arm 10, the pressure roller 8 is moved essentially toward the center point M of the coiler drum 3 and presses the strip in an optimum manner as a result.

Accordingly, the basic concept resides in that the moment of inertia required for a movement of the pressure roller or rollers 8 is reduced in relation to known solutions, so that a more dynamic manner of operation of the winding device 1 is made possible.

In order to yield to the step 16 in the strip, essentially only the pressure roller 8 is moved which is attached to its own pivoting arm 10.

In addition, it has its own drive 7 by means of which it can be moved in the direction of the coiler drum 3 and away therefrom. This drive 9 can be effected mechanically, electrically, pneumatically, hydraulically, or a combination of the drive possibilities.

The pivoting arm 5 is prepositioned by the moving element 12 in such a way that only the pressure roller 8 has to yield to the step 16. The pressure roller 8 by itself has a significantly lower inertia than the total pivoting arm 5. Consequently, a much greater dynamic is possible. This high dynamic is advantageous especially when winding thin metal strips because the operation involves high speeds and small steps 16 of the strip.

Accordingly, the positioning of the pressure roller 8 takes place in total by the two moving elements 9 and 12. Both moving elements 9, 12 are coupled to each other through a control or regulating means, not shown, having an appropriately stored algorithm for taking into consideration the geometry of the device. The control or regulation takes into account the spreading of the coiler drum 3, the strip thickness of the strip 2, the winding speed, the position of the strip beginning and the strip end, the number of windings, the coiled diameter, as well as the geometry of the pivoting arms 5, 10. It is possible to determine in a control and regulation technical manner from the appropriate elementary geometrical relationships as to how the moving means 9, 12 are to be actuated in order to obtain the desired or required position of the pressure roller 8.

In order to permit the system to operate in a closed regulating circuit, the moving means 9, 12 are equipped with distance measuring systems 13, 14 which facilitate a precise automatic movement of the pressure roller 8 into the desired position.

If the drives 9, 12 (the hydraulic cylinders in the illustrated embodiment) with a force measuring system, the pressure roller 8 can be positioned and moved against the metal strip 2 or the coiler drum 3 (for example, for calibration) in a force-controlled manner. This has the advantage that all devices and the metal strip 2 are treated in a gentle manner. This means less damage and higher service lives.

In the case of thick strips, the winding speeds are relatively slow and the steps 16 of the strips are ramp-like, so that the requirements of the dynamics of the pressure roller or the pivoting arms are relatively low. In addition, it is possible that high contact pressure forces are required in the case of thick strips. For the operation it is advantageous to pull the pressure roller 8 by means of the moving means 9 against a rigid stop 15 which is mounted on the pivoting arm 5.

The axis 11 of the pressure roller 8 can be configured in such a way that it is without play or with little play. This can be effected by a construction of a conical seat at the bolt and conical sleeve which forms the frictional engagement for the bearing bore. The rotational movement can be carried out through a bearing which is with little play or is adjustable.

In the case of the use of a hydraulic or pneumatic drive 9 of the pressure roller 8, it has been found useful if not only one but two cylinders are provided.

If the pressure roller 8 is moved with only cylinder 9, the pressure roller 8 is to be mounted in a frame which connects the points of rotation in a torsion-stiff manner. This ensures a parallel pivoting of the pressure roller 8 relative to the coiler drum 3. If the pressure roller 8 is provided on each side (i.e. on the drive side and the operating side) with a drive 9 (for example, a hydraulic cylinder each), which pivots the roller 8 toward and away, the synchronous operation can be carried out electronically without a connection or with a torsion-stiff connection.

If none or a torsion-soft connection of the drive side to the operating side is provided, the pressure roller 8 can be used by a targeted presetting of forces (force regulation) on the drive side and on the operating side for influencing the strip travel (i.e. straight edge winding of a coil).

LIST OF REFERENCE NUMERALS

1 winding device
2 strip
3 coiler drum
4 axis of rotation
5 pivoting arm
6 axis
7 deflection plate
8 pressure roller
9 moving means
10 roller pivoting arm
11 axis
12 moving element
13 distance measuring system
14 distance measuring system
15 stop
16 step of strip
17 shaft flap
M center point

The invention claimed is:

1. A winding device (1) for winding strip (2), particularly thin metal strip, comprising a coiler drum (3) which is arranged so as to be rotatable about an axis of rotation (4), as well as at least one pivoting arm (5) which is arranged so as to be pivotable about an axis (6) and which has at least one deflection plate (7) and at least one pressure roller (8) for deflecting and pressing on the strip (2) to be wound, wherein the at least one pressure roller (8) has at least one moving means (9) for moving the pressure roller (8) relative to the pivoting arm (5), wherein the pivoting arm has moving means (12) for moving the pivoting arm (5), wherein the pressure roller (8) and the pivoting arm (5) each have a distance measuring system (13, 14) or the moving means (9, 12) of the pressure roller (8) and the pivoting arm (5) each have the distance measuring system (13, 14).

2. The winding device according to claim 1, wherein the moving means (9) move the pressure roller (8) in direction of the center point (M) of the coiler drum (3).

3. The winding device according to claim 1, wherein the pressure roller (8) is arranged at a roller pivoting arm (10) which is mounted in the pivoting arm (5), wherein the axis (6)

of the pivoting arm (5) and the axis (11) of the roller pivoting arm (10) are arranged parallel to each other.

4. Winding device according to claim 1, wherein the pressure roller (8) is arranged in a linear actuator which is attached to the pivoting arm (5).

5. Winding device according to claim 1, wherein the moving means (9) are arranged in the pivoting arm (5).

6. Winding device according to claim 1, wherein the moving means (9) are constructed as a hydraulic or pneumatic piston/cylinder system.

7. Winding device according to claim 1, wherein a stop for the pressure roller (8) is arranged on the pivoting arm (5).

* * * * *